United States Patent [19]

Ensink et al.

[11] 4,022,409

[45] May 10, 1977

[54] ELECTRICALLY DRIVEN APPARATUS FOR OPERATING A RAILWAY

[75] Inventors: Tom Ensink, Velsen-Zuid; Rieks Zonderman, Castricum, both of Netherlands

[73] Assignee: Hoogovens Ijmuiden BV, Ijmuiden, Netherlands

[22] Filed: June 30, 1976

[21] Appl. No.: 701,413

[30] Foreign Application Priority Data

June 30, 1975 Netherlands ..... 7507735

[52] U.S. Cl. ..... 246/218; 246/415 R; 246/435 R

[51] Int. Cl.[2] ..... B61L 5/06

[58] Field of Search ..... 246/218, 219, 221, 226, 246/230, 327, 344, 346, 415 R, 435 R, 225, 236; 104/130

[56] References Cited

UNITED STATES PATENTS

| | | | |
|---|---|---|---|
| 1,825,469 | 9/1931 | Milton | 246/225 |
| 1,842,393 | 1/1932 | Downes | 246/218 |
| 3,918,665 | 11/1975 | Alimanestianu | 246/415 R |

*Primary Examiner*—Trygve M. Blix
*Assistant Examiner*—Reinhard J. Eisenzopf
*Attorney, Agent, or Firm*—Stevens, Davis, Miller & Mosher

[57] ABSTRACT

Electrically driven railway point operating apparatus having a biasing device whereby, without damage to the operating mechanism the point can be forced open against its closing bias by the wheels of a vehicle. The point operating slide is moved by a lever which in turn is moved by a driving member which is driven in either of opposed directions by a reversible electric motor. The driving member carries a roller which is located in an aperture in the lever, so that relative movement of the lever and the roller is permitted. The roller is returned by the motor to an intermediate position, when a switching operation is complete, so that the lever can move relative to the roller if the point is forced open.

11 Claims, 4 Drawing Figures

ELECTRICALLY DRIVEN APPARATUS FOR OPERATING A RAILWAY

BACKGROUND OF THE INVENTION

1. Field of the Invention

This invention relates to electrically driven apparatus for operating a railway point (or a railway switch as it is also known).

2. Description of the Prior Art

To switch a point by hand in an industrial yard using a heavy counter-weight to secure the position of the tongues of the point causes a high incidence of backache in the operating personnel. Especially in yards having points made of a very heavy rail profile, e.g. 64 kg per meter, this problem is acutely felt. A significant improvement in this respect is a hand-operated point switching arrangement having an over-center toggle spring mechanism to bias the tongues into their end positions. The closing force obtainable with the construction on the tongues of the point is however smaller than that obtainable by means of weights in the switching mechanism.

Known electrically driven apparatus for operating railway points switch the point and secure its position, but do not exert a positive closing force. In particular in heavy industrial application they have the disadvantage that maintaining the necessary adjustment tolerances requires much time and effort. U.S. Pat. No. 1,842,393 illustrates a known point-operating mechanism.

In industrial rail yards it often happens that — in spite of regulations prohibiting it — points are forced open by driving a vehicle through them from the trailing side. This can damage the locking mechanism and cause dislocation of the slide system with a risk of subsequent derailments. Moreover because of the number of adjustments of play necessary and because of wear, the costs of maintenance of railway points are rather high.

SUMMARY OF THE INVENTION

It is an object of the present invention to provide an electrically driven apparatus for operating a railway point, which provides a positive closing force between the movable tongues of the point and the adjacent rail.

It is another object of the invention to provide an electrically driven apparatus for operating a railway point, which requires little maintenance and whose adjustment does not give rise to serious problems.

A further object is to provide an electrically driven apparatus for operating a railway point which is designed so that the point which it operates has low susceptibility to slight dirtying or to snow.

Yet another object is to provide an apparatus for operating a railway point which is insensitive to forcing open of the point, so that if the point is accidentally forced open, neither the point nor the operating apparatus is damaged.

A yet further object of the invention is to provide electrically driven apparatus for operating a railway point which is suitable for use in industrial rail yards, is remotely controllable, and is simple to operate and reliable in use.

According to the present invention, there is provided electrically driven apparatus for operating a railway point, which has a slidable operating member for moving the tongues of the point between their two extreme positions, biassing means connected to the slidable operating member to hold it in either one of the said extreme positions, and electric motive means arranged to move the slidable operating member to switch the point from one extreme position to the other. This apparatus is especially characterized in that there is provided a driving member movable by the motive means in either of two opposed directions and carrying a driving element which is located in an aperture in a lever connected to the slidable operating member so that movement of the driving member moves the lever thereby switching the point, the aperture being of a size and shape to permit relative movement of the lever and the driving element and there being provided control means for the electric motive means which control means operates, when the point has reached one of said extreme positions in a switching operation, to cause reversal of the driving motive means so as to bring the said driving member back to an intermediate position at which the said driving element thereof is located in such a position in said aperture that movement of the lever relative to the driving element is permitted if the point is forcibly moved by the wheels of a vehicle.

The invention is especially advantageous when the biassing mean is an over-center spring toggle mechanism, in which case the said lever can provide one arm of the toggle mechanism. Thereby, a suitable positive pressing force of the tongues on the rails in the extreme positions of the point can be obtained, while the quick switching movement obtainable with an electric motor makes the point less sensitive to dirt or snow.

Preferably, the lever is L-shaped, i.e. has two arms substantially perpendicular to each other and is pivotally mounted at the junction of the said arms, one said arm being connected to the said operating member and the other arm having the said aperture, whereby the direction of movement of the said driving member is substantially perpendicular to that of the operating member. In this way a compact arrangement can be designed.

The aperture in the lever which receives the driving element, which is preferably a roller, may be any suitable shape.

A closed trapezoidal shape, with rounded corners, is especially preferred.

Preferably a single reversible electric motor constitutes th electric motive means. As the motor should be rotatable in both directions, it is preferred to use a series d.c. motor having split field windings. This type of motor is commercially available; its use with an electrically driven apparatus for operating railway points has certain advantages, however.

In order to return the said driving element after the switching of the point towards its central position with an adjusted speed lower than the speed with which the switching lever is operated, for each direction of rotation a series resistor is preferably inserted in the motor current circuit at this stage.

In order to stop the driving element as quickly as possible when the desired central position is reached, for each direction of rotation preferably there is provided a short circuit which bridges over the series circuit of the motor armature and field winding when the mains voltage is interrupted.

Preferably, the control means includes a slidable control member which, in use, is connected independently to the tongues of the point, the control means controlling the electric motive means in dependence on the position of the slidable control member.

BRIEF INTRODUCTION OF THE DRAWINGS

The preferred embodiment of this invention will now be described, by way of non-limitative example and with reference to the accompanying drawings, in which.

DESCRIPTION OF THE PREFERRED EMBODIMENT

Figure 1:
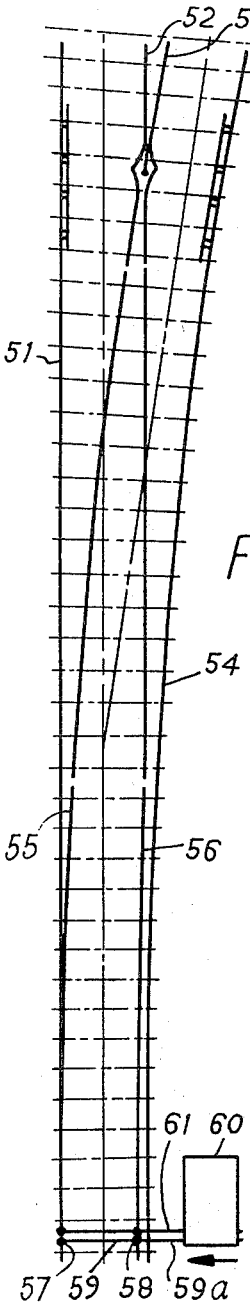
FIG. 1 is a plan view of a railway point or switch in a first one of its two extreme positions.
Figure 2:
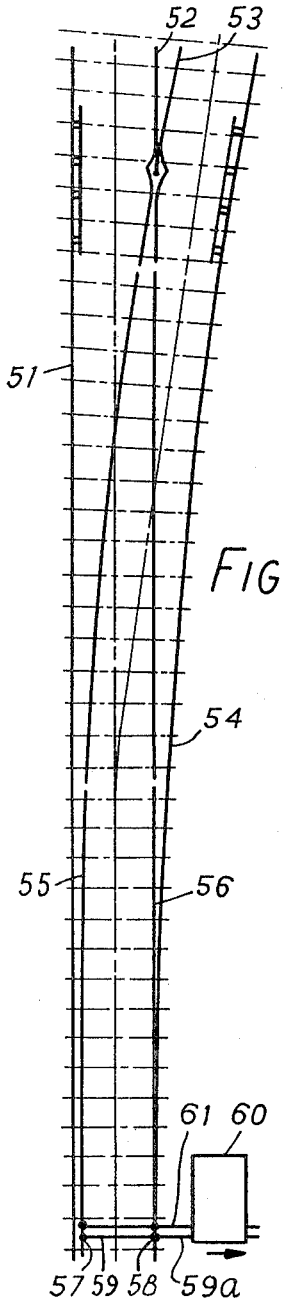
FIG. 2 is a plan view of the point of FIG. 1 in the other of its two extreme positions.

FIGS. 1 and 2 show a point of the type that provides the choice of running over a through track which is straight or over a curved divergent track. The straight track is formed by the fixed rails 51 and 52 together with the movable tongue 56 when in the position seen in FIG. 2, while the curved track is formed by the fixed rails 53 and 54 together with the movable tongue 55 when in the position shown in FIG. 1. It is remarked that the invention provides equally good results with other types of points.

The two movable tongues 55 and 56 of the point can be brought into the positions indicated respectively in FIGS. 1 and 2, by moving a connection rod 59*a* in the directions indicated by the arrows in the respective Figures. In the position of FIG. 1 for example the route over the curved rails 53 and 54 is set for use. In this position the tongue 55 which is to be run over should be firmly pressed against the fixed rail 51 of the other track. If a rail vehicle approaches over the track formed by rails 51 and 52 in order to pass through the point on the trailing direction, the tongues 55 and 56 can be pushed away against spring pressure holding the tongue 55 against the rail 51 by the flanges of the wheels running on the track. Similarly in the position of FIG. 2, the tongue 56 can be pressed away from the rail 54 against spring pressure.

A coupling rod 59, which can be adjusted is secured between the ends 57 and 58 of the tongues 55 and 56. This coupling rod 59 is fixed to the connection rod 59*a*, which is also adjustable and which is connected to a slidable operating member 102 (hereinafter called slide 102). The slide 102 is part of the point operating apparatus embodying the invention which is shown as a box 60 in FIGS. 1 and 2 and is shown in detail in FIG. 3 with the box lid removed. The ends 57 and 58 of both tongues 55 and 56 are also connected by a connection rod 61 to a so-called control side 123 in the box 60.

Figure 3:
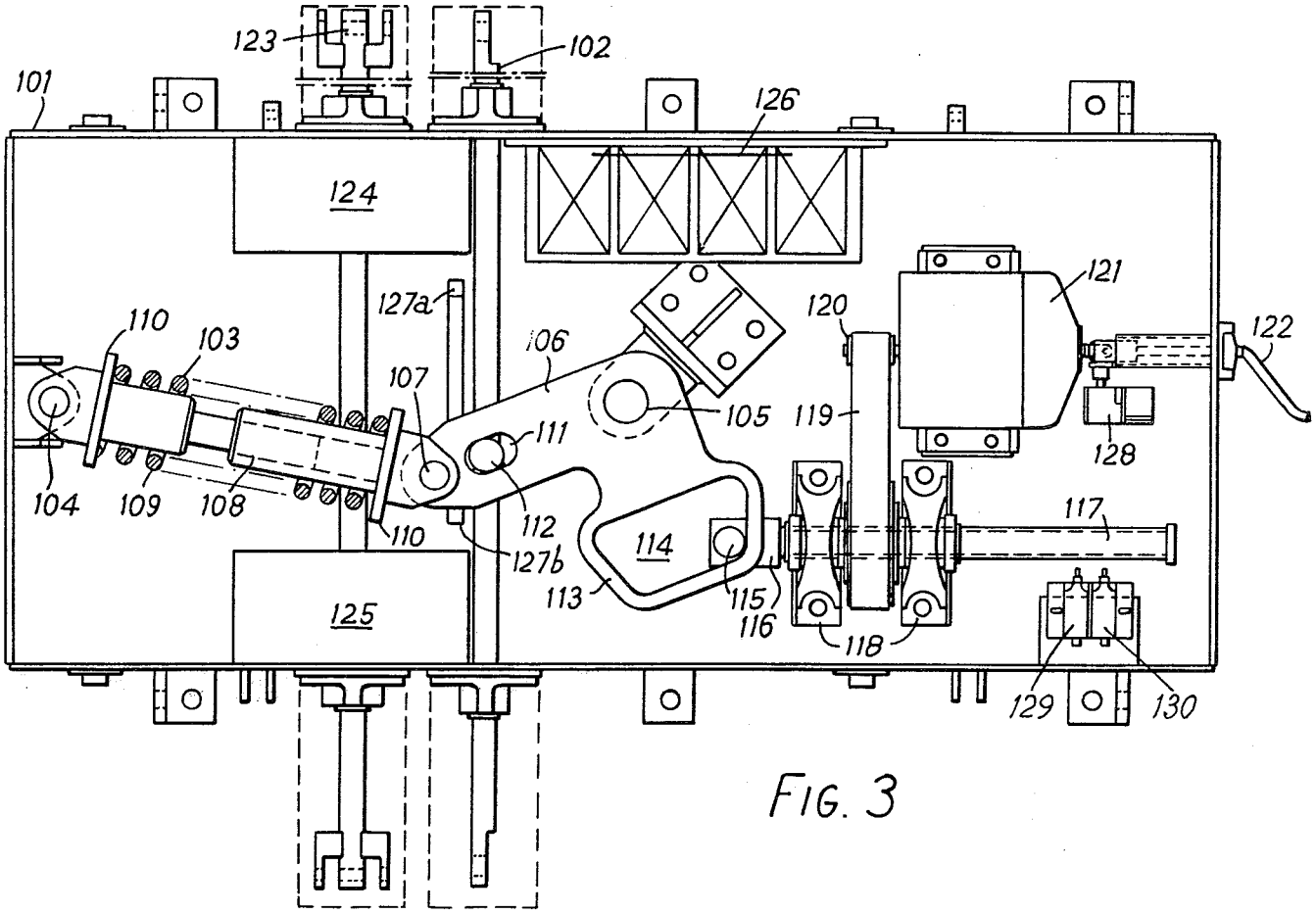
FIG. 3 is a plan view of the apparatus embodying the invention, which is associated with the point of FIGS. 1 and 2.

In FIG. 3, it can be seen that the slides 102 and 123 are slidably movable to and fro though the side walls 101 of the box with dust-tight seals to the sidewalls. The construction is such that the apparatus, while remaining in the same orientation relative to the point, can be arranged either to the left or to the right of the point, as seen in FIG. 1.

The operating slide 102 and thus also the connection rod 59*a* and the tongues 55 and 56 are moved between the extreme positions of the point shown in FIGS. 1 and 2 through an over-center toggle spring mechanism 103. This mechanism also spring biasses the point into whichever of the two extreme positions it is located. The mechanism 103 has an L-shaped switching lever 106, and a telescopic arm 108 mounted between two fixed points of rotation 104 and 105 and joined at an articulation point 107. The telescopic arm 108 is urged to expand by a compression spring 109 secured between two flanges 110.

In the longer leg of the lever 106, which forms one arm of the toggle mechanism, between the point of rotation 105 and the articulation point 107 there is a longitudinal slot 111 in which a pin 112 on the slide 102 is located. When the lever 106 is switched over from one position of rest to the other, the pin 112 is carried with it thus moving the slide 102 longitudinally.

On its shorter leg, which is fast with and perpendicular to the longer leg, the lever 106 has a head 113 in which there is an approximately trapezoidal aperture 114, in which a driving element in the form of a roller 115 is positioned. The aperture 114 is of trapezoidal shape in the plane of movement of the lever 106; the axis of the roller 115 is perpendicular to this plane. The aperture 114 is much larger than the roller 115 so that relative movement can occur. The roller 115 is secured on the head 116 of a driving member in the form of a threaded spindle 117, which is carried by two bearing blocks 118 and is driven through a nut located between the blocks 118 by means of a toothed belt 119 from toothed wheel 120 mounted on the shaft of an electric motor 121. Thus the spindle 117 can be moved by the motor 121 in either of two opposed directions, its axis of movement being in the same plane as, but perpendicular to, that of the slide 102.

The spindle 117 is shown in FIG. 3 in its extreme right position, i.e. that in which the driving roller 115 has moved the lever 106 around the point of rotation 105 in the anti-clockwise direction. This movement moves the head of the lever 106 adjacent the articulation 107 away from a fixed stop 127*a* towards the stop 127*b* thus moving the slide 102 downwardly and switching the point. In neither of the two extreme positions however is the lever in contact with these stops 127*a*, 127*b*, because it is essential that the toggle mechanism 103 always exerts the desired positive pressing force on the appropriate tongue of the point to bias the tongue against the fixed rail.

The new point position is sensed by control contacts 124 and 125 actuated by the control slide 123, which is separately connected to each tongue separately from the slide 102.

When the control slide 123 through one of the control contacts 124 and 125 has signalled that the point has in fact adopted the other position, the spindle 117 is brought into a central position in its stroke by reversal of the direction of rotation of the motor 121. For instance this movement may bring the driving roller 115 to a position halfway across the trapezoidal aperture 114. Accidental forcing open of the point can take place without damage to the driving means 115 to 121. The speed of this return movement of the spindle is less than its speed when actually driving the lever 106 in rotation to switch the point.

Two contacts 129 and 130 are arranged alongside the threaded spindle 117, so that they are engaged and actuated by the passing spindle. The reversal of the direction of rotation of the motor 121 to return the spindle 117 at lower speed towards the intermediate rest position is performed under control of relays 126 indicated schematically in FIG. 3, as explained below.

Figure 4:
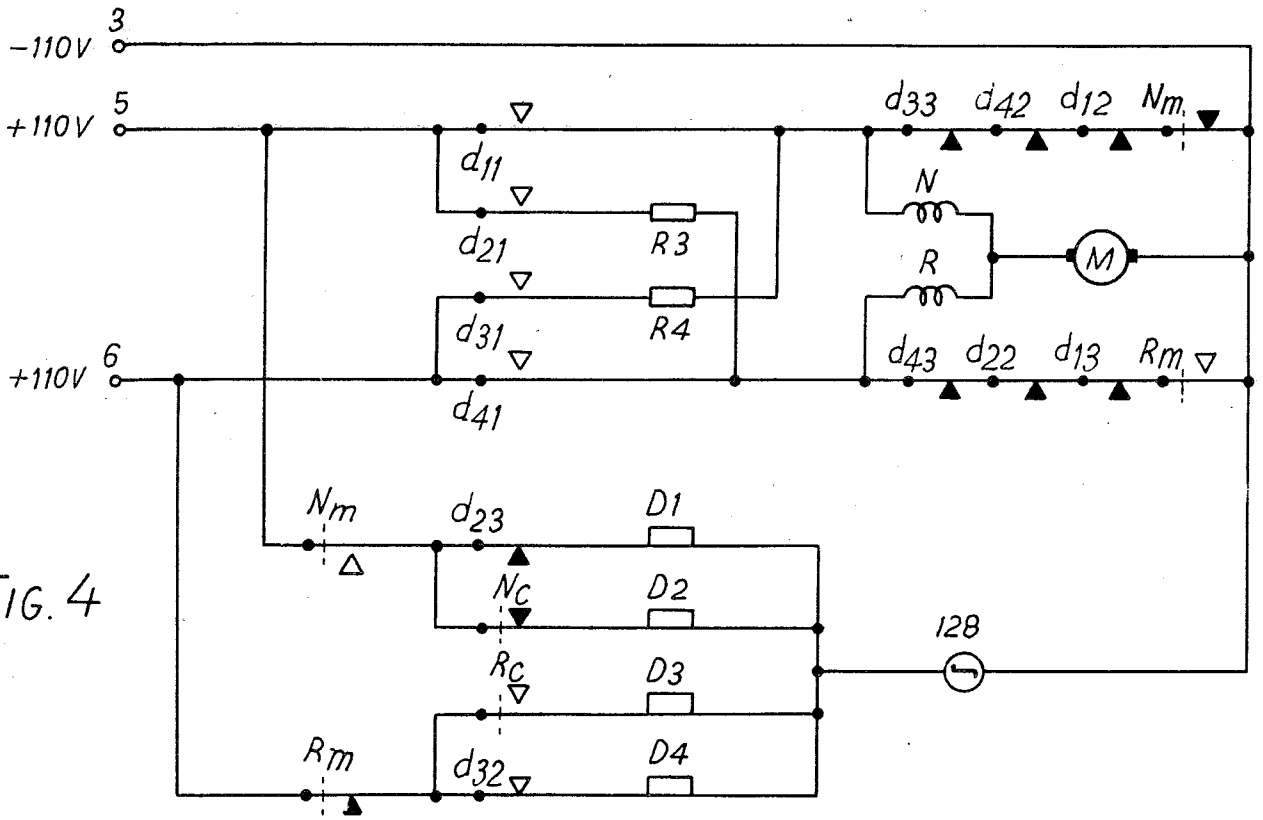
FIG. 4 is a circuit diagram illustrating the electrical connections of the apparatus of FIG. 3.

The diagram of FIG. 4 is drawn according to the standards used by railway companies; a making contact is indicated by a triangle over the line, an opening contact by a triangle under the line; full and against the line if closed; open and free from the line if open.

The electric motor 121 of FIG. 3 is, as shown in FIG. 4, a reversible series d.c. motor having split field windings; the armature is indicated by M, and the field windings respectively by N and R. The contacts 124 and 125 which are actuated by the control rod 123 of FIG. 3 are indicated as Nc and Rc in FIG. 4. Contact Nc is closed when the point is set for the straight-on direction for the traffic as shown in FIG. 2, whereas contact Rc is closed for the divergence alternative as shown in FIG. 1.

The contacts 129 and 130 actuated by the spindle 117 are indicated in FIG. 4 as $R_m$ and $N_m$; they are double contacts as indicated, i.e. there are two contacts labelled $R_m$ in FIG. 4, for example. The four relays 126 in FIG. 3 are indicated in FIG. 4 as D1, D2, D3 D4; they each have three contacts $d_{11}$, $d_{12}$, $d_{13}$; $d_{21}$, $d_{22}$, $d_{23}$; etc. The circuit of FIG. 4 also includes terminals 3, 4 and 5 and resistors R3 and R4. The position of the contacts shown in the diagram of FIG. 4 corresponds to the position of the point shown in FIG. 2 with the spindle 111 in its central position. (As already mentioned, this is not the position illustrated in FIG. 3). When the point is switched from one position (N, FIG. 2) towards the other position (R, FIG. 1), the following happens:

The appropriate one of two press buttons (not shown) respectively for N and for R, is depressed. For convenience the sequence following depression of the button for R will be followed; this is the command for the switching of the point from the N position to the R position. Depression of the button for R causes the application of a voltage of +110V at terminal 6 (conversely depression of the button for N applies the voltage to terminal 5), and actuates a hold relay (not shown) which maintains the voltage on terminal 6 after the button is released.

The voltage on terminal 6 operates relay D4 via closed contacts $R_m$ and $d_{32}$. Relay D4 closes contacts $d_{41}$ and opens contacts $d_{42}$ and $d_{43}$. Motor M receives current via terminal 6, contact $d_{41}$, field winding R, armature M, terminal 3. The motor M rotates and, through the spindle 117, roller 115 and lever 106, moves the toggle mechanism over-center, thus switching the point from the N position to the R position.

When the point has fully reached the R position, the control slide 123 actuates the contact 125 (i.e. contact Rc of FIG. 4). Closure of Rc causes operation of relay D3, which then opens contact $d_{32}$. This de-energizes relay D4, which opens contact $d_{41}$, breaking the circuit through the motor M. At the same time, contact $d_{31}$ is closed, while contact $d_{33}$ is opened, and contacts $d_{42}$ and $d_{43}$ are closed.

The closing of contact $d_{31}$ causes the motor M to receive current via terminal 6, contact $d_{31}$, resistor R4, field winding N, armature M, terminal 3. Thus the motor M is reversed, and runs more slowly than in the actual point-switching motion, until the spindle 117 has been almost returned to the central position at which the roller 115 has the desired location with respect to the aperture 114.

Just before the desired central position of the spindle is reached, the spindle 117 actuates double contact 129 (i.e. both contacts $R_m$ of FIG. 4) with the result that relay D3 is de-energized, which causes opening of contact $d_{31}$, removing the voltage from the motor M. Furthermore, the closure of contact $d_{33}$ as well establishes short circuit through the motor along the path field winding N, armature M, contacts $N_m$, $d_{12}$, $d_{42}$, $d_{33}$. This rapidly brings the motor to a standstill.

The complementary operations occurring in the complementary circuit portions when the command button for N is depressed need not be described.

If the point, in spite of the regulations is nevertheless forced open by the wheels of a vehicle, the control contacts come into a different position, so that the apparatus cannot be operated again. A counter or a telesignalling contact can be present in the box to indicate that the point has been driven open.

The relays D1 to D4 can be switched off by means of a crank contact 128, which is opened with the crank 122 (FIG. 3) is actuated. By means of this crank 122 the point can be switched by hand in the event of an emergency.

While the invention has been illustrated above by reference to the preferred embodiment thereof, it will be understood by those skilled in the art that various changes may be made without departing from the spirit and scope of the invention and it is intended to cover all such changes and modifications by the appended claims.

What is claimed is:

1. Electrically driven apparatus for operating a railway point having a. a slidable operating member for moving the tongues of the point between their two extreme positions to switch the point, b. biassing means connected to the said operating member and adapted to act upon the said operating member so as to hold the tongues of the point in whichever one of the said extreme positions the point is located, c. a lever connected to the said operating member, the lever having an aperture at a location spaced from the said operating member, d. a driving member having a driving element located in the said aperture in the said lever, the aperture being of a size and shape to permit relative movement of the lever and the driving element, e. electric motive means adapted to move said driving member in either of two opposed directions, the arrangement being such that the electric motive means moves the operating member through the said driving element and the said lever, so as to switch the point from either one of said extreme positions to the other, f. control means for said electric motive means, arranged to be actuated when the point reaches one of said extreme positions in a switching operation, and adapted when so actuated to cause reversal of the electric motive means to bring the said driving member back to an intermediate position at which the said driving element is so located in the said aperture that the lever can move relative to the driving element if the point is forcibly moved by the wheels of a passing vehicle.

2. Apparatus according to claim 1 wherein the lever has two arms substantially perpendicular to each other and is pivotally mounted at the junction of the said arms, one said arm being connected to the said operating member and the other arm having the said aperture, whereby the direction of movement of the said driving member is substantially perpendicular to that of the operating member.

3. Apparatus according to claim 1 wherein the said biassing means is an over-center spring toggle mechanism, the said lever providing one arm of the toggle mechanism.

4. Apparatus according to claim 1 wherein the said aperture is trapezoidal in shape in the plane of movement of said lever and the said driving element.

5. Apparatus according to claim 1 wherein the said electric motive means is a reversible electric motor.

6. Apparatus according to claim 5 wherein the electric motor is a series d.c. motor with split field windings.

7. Apparatus according to claim 6 wherein the said control means has, for each direction of rotation of the said electric motor, a resistor which is inserted in series with the motor in the motor circuit so that the motor runs at a lower speed when returning said driving member to said intermediate position than when actually switching the points.

8. Apparatus according to claim 6 wherein the control means is arranged to short circuit the motor armature and field winding when the said driving member has been returned to said intermediate position.

9. Apparatus according to claim 1 wherein said driving element is a roller rotatably mounted on the driving member.

10. Apparatus according to claim 1 wherein said control means includes a slidable control member which, in use, is connected independently to the tongues of the point, the control means controlling the electric motive means in dependence on the position of the slidable control member.

11. In an electrically driven apparatus for operating a railway point, which has a slidable operating member for moving the tongues of the point between their two extreme positions, biassing means connected to the slidable operating member to hold it in either one of the said extreme positions, and electric motive means arranged, to move the slidable operating member to switch the point from one extreme position to the other, the improvement comprising a driving member movable by the motive means in either of two opposed directions and carrying a driving element which is located in an aperture in a lever connected to the slidable operating member so that movement of the driving member moves the lever thereby switching the point, the aperture being of a size and shape to permit relative movement of the lever and the driving element and there being provided control means for the electric motive means, which control means operates when the point has reached one of said extreme positions in a switching operation, to cause reversal of the driving means so as to bring the said driving member back to an intermediate position at which the said driving element thereof is located in such a position in said aperture that movement of the lever relative to the driving element is permitted if the point is forcibly moved by the wheels of a vehicle.

* * * * *